US009596930B2

(12) United States Patent
VanHeusden et al.

(10) Patent No.: US 9,596,930 B2
(45) Date of Patent: Mar. 21, 2017

(54) PIVOTING ADD-ON STORAGE CADDY

(71) Applicant: Linda Carol VanHeusden, Beverly Hills, MI (US)

(72) Inventors: Linda Carol VanHeusden, Beverly Hills, MI (US); Christos Ragias, New Albany, OH (US); Nick Vallo, Columbus, OH (US)

(73) Assignee: Linda Carol VanHeusden, Beverly Hills, MI (US)

( * ) Notice: Subject to any disclaimer, the term of this patent is extended or adjusted under 35 U.S.C. 154(b) by 0 days.

(21) Appl. No.: 14/545,518

(22) Filed: May 15, 2015

(65) Prior Publication Data

US 2016/0331129 A1 Nov. 17, 2016

Related U.S. Application Data

(63) Continuation-in-part of application No. 13/998,912, filed on Dec. 20, 2013, now abandoned.

(60) Provisional application No. 61/848,461, filed on Jan. 4, 2013.

(51) Int. Cl.
*A47F 5/00* (2006.01)
*A47B 49/00* (2006.01)
*A47B 45/00* (2006.01)

(52) U.S. Cl.
CPC ..... *A47B 49/00* (2013.01); *A47B 45/00* (2013.01)

(58) Field of Classification Search
CPC ..... A47B 49/00; A47B 45/00
USPC ..... 211/70.6, 119.003, 86.01, 96, 150, 168, 211/170; 220/23.86, 23.83, 23.2, 23.88, 220/23.89, 23.4; 312/408, 298, 274, 326, 312/405.1; 108/141, 139, 137; 206/373, 206/225
See application file for complete search history.

(56) References Cited

U.S. PATENT DOCUMENTS 589,463 A * 9/1897 Case ..... A47B 88/18 211/126.1
719,625 A * 2/1903 Throm ..... A47B 21/02 108/42
966,333 A * 8/1910 Hemming ..... B42F 17/02 211/51
1,414,826 A * 5/1922 Meyerson ..... B25H 3/023 190/30
1,554,818 A * 9/1925 Greenstreet ..... A47F 3/06 211/26
1,576,716 A * 3/1926 Casgrain ..... A43D 111/006 108/94
2,104,939 A * 1/1938 Whalen ..... F25D 25/027 312/300
2,116,564 A * 5/1938 D'Olive ..... F25D 25/02 312/310

(Continued)

*Primary Examiner* — Joshua J Michener
*Assistant Examiner* — Devin Barnett
(74) *Attorney, Agent, or Firm* — Warn Partners, P.C.

(57) ABSTRACT

Pivoting add-on storage caddy includes a frame member having a width, a height, and first and second ends to define a length; and a pivot about the first end, which has at least two pivoting contrivances that can be adjustably and slidably substantially spaced apart vertically in a direction substantially parallel with the height. The frame member may be inclusive of a vertical door component and a laterally projecting tray component. The caddy may be provided in kit form. The caddy can be mounted to a vertical support of an open storage rack or another substrate structure.

11 Claims, 12 Drawing Sheets

(56) References Cited

U.S. PATENT DOCUMENTS 2,266,857 A * 12/1941 Field ..... F25D 23/025 312/138.1
2,562,056 A * 7/1951 Norberg ..... F25D 23/04 211/90.01
2,574,250 A * 11/1951 Dalton ..... B60N 3/102 108/45
2,597,473 A * 5/1952 Green ..... A45C 5/005 132/315
2,684,225 A * 7/1954 Johnson ..... A47G 25/08 16/223
2,955,892 A * 10/1960 Pulaski ..... A47B 49/004 211/150
2,978,113 A * 4/1961 Anderson ..... A47B 51/00 108/141
3,012,679 A * 12/1961 Richter ..... A47B 49/004 108/139
3,063,775 A * 11/1962 Snowman ..... F25D 25/027 108/141
3,111,123 A * 11/1963 Le Fort ..... A47J 37/0772 108/141
3,131,011 A * 4/1964 Rittenberry ..... A47B 69/00 108/28
3,135,392 A * 6/1964 Elkins ..... A47D 15/00 206/380
3,167,186 A * 1/1965 Squire ..... F25D 25/027 108/141
3,172,715 A * 3/1965 Powder ..... F25D 25/027 108/106
3,185,116 A * 5/1965 Gilbert ..... F25D 25/027 108/139
3,269,550 A * 8/1966 William ..... B25H 3/04 211/70.6
3,754,503 A * 8/1973 Hennells ..... B30B 9/3003 100/100
3,843,223 A * 10/1974 Schneider ..... B65B 67/1216 312/211
3,869,752 A * 3/1975 Klay ..... E05D 3/02 16/234
3,917,106 A * 11/1975 Bargetzi ..... G04D 1/066 206/349
4,867,332 A * 9/1989 Mains ..... B25H 3/04 206/372
5,090,587 A * 2/1992 Brown ..... A47F 5/0018 211/81
5,513,910 A * 5/1996 Ellingwood ..... F25D 23/04 211/106
5,530,992 A * 7/1996 Baermann ..... E05D 15/505 16/231
5,564,566 A * 10/1996 Lamb ..... B25H 3/04 206/349
5,590,804 A * 1/1997 Crum ..... A47J 47/20 220/23.86
5,685,624 A * 11/1997 Lee ..... F25D 23/04 312/274
5,735,413 A * 4/1998 Allen ..... A47B 46/00 211/107
5,839,771 A * 11/1998 DeMars ..... A47L 13/51 206/225
6,105,844 A * 8/2000 Walters ..... A45C 3/00 206/541
6,158,360 A * 12/2000 Cheng ..... A47B 49/004 108/103
6,186,608 B1 * 2/2001 Pink ..... F25D 23/04 312/321.5
6,223,921 B1 * 5/2001 Huang ..... A45C 11/24 132/295
6,595,609 B1 * 7/2003 Greiner ..... A45C 11/16 206/6.1
6,648,390 B1 * 11/2003 Yang ..... A47B 49/00 206/821
6,769,553 B1 * 8/2004 Hurt ..... A47F 7/0028 211/60.1
6,823,992 B2 * 11/2004 Redzisz ..... A45C 13/04 206/373
6,837,383 B1 * 1/2005 McElhaney, Jr. ..... B25H 5/00 206/373
6,959,972 B2 * 11/2005 Cude ..... E05D 15/56 16/351
7,182,416 B1 * 2/2007 Greiner ..... A47F 7/02 206/6.1
7,232,039 B2 * 6/2007 Doran ..... B44D 3/04 211/74
7,360,659 B1 * 4/2008 Yoon ..... H02B 1/306 16/221
7,877,920 B2 * 2/2011 Szuminski ..... A47B 81/005 109/51
8,283,576 B2 * 10/2012 Schell ..... H02B 1/36 174/32
8,596,454 B1 * 12/2013 Carlson ..... B25H 3/06 182/129
8,844,717 B1 * 9/2014 Ross ..... B25H 3/00 182/129
2003/0213760 A1 * 11/2003 Lee ..... B25H 3/003 211/70.6
2004/0055979 A1 * 3/2004 Fabregas ..... B25H 3/06 211/70.6
2005/0167306 A1 * 8/2005 Ho ..... B25H 3/023 206/373
2006/0011502 A1 * 1/2006 Redzisz ..... B25H 3/00 206/373
2006/0102569 A1 * 5/2006 Laga ..... A47F 5/0807 211/70.6
2007/0102381 A1 * 5/2007 Nguy ..... B25H 3/025 211/70.6
2007/0103892 A1 * 5/2007 McDaniel ..... A45C 13/28 362/119
2007/0159041 A1 * 7/2007 Lucas ..... F25D 23/067 312/408
2007/0235397 A1 * 10/2007 Wannop ..... A47B 77/16 211/81
2007/0267952 A1 * 11/2007 Koo ..... F25D 23/04 312/405.1
2008/0041799 A1 * 2/2008 Nguy ..... B25H 3/023 211/70.6
2008/0230500 A1 * 9/2008 Johnson ..... A47G 25/06 211/119.004
2009/0008281 A1 * 1/2009 Williams ..... B25H 3/00 206/373
2009/0101539 A1 * 4/2009 Qian ..... B01L 9/06 206/763
2010/0012599 A1 * 1/2010 Knudsen ..... G02B 6/4452 211/26
2010/0127029 A1 * 5/2010 Lee ..... B62J 7/04 224/418
2011/0247990 A1 * 10/2011 Chai ..... A47L 15/503 211/150
2012/0000812 A1 * 1/2012 Gunter ..... A45D 8/00 206/525
2012/0001528 A1 * 1/2012 Ye ..... G06F 1/181 312/327
2012/0043873 A1 * 2/2012 Jeon ..... F25D 23/028 312/405.1
2013/0033163 A1 * 2/2013 Kang ..... F25D 23/04 312/405.1
2013/0068709 A1 * 3/2013 Liu ..... B25H 3/04 211/70.6
2015/0122758 A1 * 5/2015 Telthorster ..... A47B 46/005 211/150
2016/0183737 A1 * 6/2016 Yang ..... F16B 7/105 211/119.009

* cited by examiner

PIVOTING ADD-ON STORAGE CADDY

CROSS-REFERENCE TO RELATED APPLICATIONS

This is a continuation-in-part of co-pending patent application No. U.S. Ser. No. 13/998,912 filed on Dec. 20, 2013 A.D., which, as does this through that '912 parent, claims benefits under 35 USC 119(e) of provisional No. U.S. 61/848,461 filed on Jan. 4, 2013 A.D. Those applications are incorporated herein by reference in their entireties.

FIELD AND PURVIEW OF THE INVENTION

This concerns a pivoting device for add-on storage, notably with open shelving.

BACKGROUND TO THE INVENTION

Storage with access to stored items is often at a premium around the home, garage or shop. In attempts to address this and other concerns, in general, various provisions have been made in various fields of endeavor, among which are noted the following:

U.S. Pat. No. 29,151 to Ferguson for a clothes frame.
U.S. Pat. No. 40,088 to Bacon for a card rack.
U.S. Pat. No. 183,793 to Buffington for desks.
U.S. Pat. No. 649,648 to Splivalo for a drying apparatus.
U.S. Pat. No. 719,625 to Throm for a shelf attachment for desks.
U.S. Pat. No. 952,603 to Carroll for a display rack.
U.S. Pat. No. 1,974,272 to Heineman for a spindleless display device.
U.S. Pat. No. 1,994,044 to Michelet for a combination kitchen equipment cabinet.
U.S. Pat. No. 2,414,752 to Mabie for a wall support with pivoted racks.
U.S. Pat. No. 2,955,892 to Pulaski et al. for a swing-out refrigerator shelf assembly.
U.S. Pat. No. 2,976,101 to Rooney for drop guards for refrigerator door shelves.
U.S. Pat. No. 3,053,602 to Golenpaul for a cabinet.
U.S. Pat. No. 3,078,133 to Schauer for a pivotally and vertically movable shelf structure.
U.S. Pat. No. 4,502,742 to Neff for a storage unit.
U.S. Pat. No. 5,269,231 to Johnson for a shelf apparatus.
U.S. Pat. No. 5,536,080 to Madimenos et al. for a free standing work station.
U.S. Pat. No. 6,086,033 to Calleja for a warehouse displayer panel system and hinge.
U.S. Pat. No. 6,419,332 B1 to Caldwell, Jr. et al. for a file cabinet.
U.S. Pat. No. 6,978,905 B2 to Chen for a supporting frame with a casing. Publication No. US 2007/0085456 A1 of Farrens for a display cabinet.
Publication No. US 2007/0159041 of Lucas et al. for means for providing adjustment to bins and shelves in refrigerators.
The InvisiVault® in-wall safe/utility cabinet, which pivotally mounts over a wall opening.
Miscellaneous wall racks, which are mounted on walls.
As well, open storage racks such as those hand built from wood and those purchased and assembled, to include those with metal or plastic frame supports, are popular options in storage.

Other art is known to exist from additional searching by or on behalf of Trident Design, L.L.C. Identified in addition to Neff, which is cited above, are the following:

U.S. Pat. No. 3,908,954 to Nix for a telephone directory binder support and storage apparatus.
U.S. Pat. No. 6,158,360 to Cheng for a multi-level rotational shelf structure. U.S. Pat. No. 6,568,772 B2 to Gerkey et al. for a rotatable shelf.
U.S. Pat. No. 7,360,659 B1 to Yoon et al. for a space-saving mounting fixture for use with an equipment rack.
U.S. Pat. No. 8,061,536 B2 to Lin et al. for a tool box fastening device for fastening a tool box set to a vertical wall.
Publication No. US 2003/0042830 A1 of Gregorio for a pivoting television support shelf.
Publication No. US 2004/0061298 A1 of Sandoval for a tool caddy.
Publication No. US 2005/0211742 A1 of Mapes et al. for a post-mounted storage caddy.
Publication No. US 2010/0193456 A1 of Polizzi et al. for a pivoting shelf assembly.
Publication No. EP 1 220 224 A3 (with search report) of Erickson et al. (Gateway, Inc.) for a hinged mounting for multiple storage drives.
Its A2 publication and U.S. Pat. No. 6,392,875 B1 correspond. See also, U.S. Pat. No. 6,862,172 B2, a continuation of the '875 patent.

Of the foregoing, it was expressed that Neff, Cheng and Yoon et al. were most relevant. However that may be, in addition, various aftermarket, adjustable storage, and related products were identified as being in the market:

A. Garage/industrial products: Racor hanger; GoRhino carrier; Facom pivoting shelf; Displays 2 Go baker's rack; Gratnell's mobile adjustable shelving; $1199.99 Swivel Storage Products cabinet; IAC Industrial D4 rolling cart; Lista equipment shelf; Nomad 4 browser; storage doors.

B. Household accessories: Lynk over-cabinet-door organizer; Umbra jewelry box; Moen shower caddy; modular shower station; Cabidor behind door storage; Rev-a-Shelf shelving; Imeca D-shaped lazy Susan; Brookhaven swing-out spice rack; hinge-mounted cabinet hinge; hinged, wall-mount storage cabinets; swiveling pantry storage; art cabinet.

C. Stock shelving: Blue Hawk shelf; HDX shelving; EnviroElements shelving; Style Selections shelving; Edsel shelf; Gladiator shelf.

D. Inspiration category: BLine Spinny drawers; Alog modular shelving system; articulated bookshelf; Basso shelf; BrickBox furniture; spindle storage box.

Other art, cited during prosecution of the parent in addition to citations duplicated from those set forth above, includes the following citations:

U.S. Pat. No. 2,104,939 to Whalen for a refrigerator shelf.
U.S. Pat. No. 2,116,564 to D'Olive for a movable carrier for storage cabinets.
U.S. Pat. No. 3,131,011 to Rittenberry for a supporting device.
U.S. Pat. No. 3,754,503 to Rennels for a waste compactor with foot actuated release mechanism.
U.S. Pat. No. 3,869,752 to Klay for a hinge assembly.
U.S. Pat. No. 4,156,450 to Lee for a portable soap caddy assembly.
U.S. Pat. No. 4,960,257 to Waters for an easel.
U.S. Pat. No. 5,530,992 to Baermann for double-sided hinges.
U.S. Pat. No. 5,685,624 to Lee for a door for a refrigerator having rotatable pockets.
U.S. Pat. No. 5,845,793 to Pan to a multi-functional display rack.

U.S. Pat. No. 6,260,296 B1 to Carney, Jr. for a photograph display system.

U.S. Pat. No. 6,634,727 B2 to Torres for closet doors with integrated shelves.

U.S. Pat. No. 6,959,972 B2 to Cude for a tri-action hinge and latching mechanism for a door panel.

Publication No. US 2005/0183240 A1 to Watkins for an automatic lift and turn hinge and gate.

Publication No. US 2006/0191066 A1 to Johnson et al. for a shower door storage assembly. It issued as U.S. Pat. No. 8,060,955 B2.

Publication No. US 2008/0230500 A1 of Johnson for hinge-mounted hanger systems. It issued as U.S. Pat. No. 7,908, 711 B2.

Publication No. US 2012/0001528 A1 of Ye for a computer. It issued as U.S. Pat. No. 8,292,377 B2.

Publication No. US 2012/0060420 A1 of Johnson et al. for a shower door storage assembly. It is a divisional to U.S. Pat. No. 8,060,955 B2.

Yet, difficulties in storage remain. In particular, storage difficulties can be engendered by an over-abundance of items to be stored and/or large shelves that make placement and retrieval of smaller items, oftentimes among larger items, problematic.

It would be desirable to more effectively address storage problems, notably in the field of popular storage rack options such as open shelving for the home, garage or shop. It would be desirable, in particular, to address the under-capacities of open shelving units while avoiding problems in placement and retrieval of items, to include smaller items. It would be desirable to provide the art an alternative.

A FULL DISCLOSURE OF THE INVENTION

Provided hereby is a pivoting add-on storage caddy, which comprises a frame member having a width, a height, and first and second ends to define a length; and a pivot about the first end, which has at least two pivoting contrivances that can be adjustably and substantially spaced apart vertically in a direction substantially parallel with the height. The frame member can include a vertical door component and a laterally projecting tray component. In one embodiment, the pivot can comprise a vertically oriented hinge pin attached to the first end of the frame member, and at least two hinge plates pivotally, vertically, slidably mounted on the hinge pin. In another exemplary embodiment, the caddy has a pivot comprising a split, vertically oriented hinge post ensemble that is pivotally associated with a corresponding securing contrivance, in which a vertically slidable relationship exists with respect to hinge posts of the ensemble. The caddy is capable of being vertically, pivotally mounted on variously endowed vertical supports of open storage racks, generally with the frame member smaller in size than the open storage racks to which the caddy can be pivotally attached, for example, being substantially less in width, or in width and height, in width and length, or in width, height and length, than the open storage rack. As well, the caddy is capable of being mounted to other substrate structures, for example, surfaces as of exposed studs in the garage, basement or attic. The caddy can be a see-through device when made with a see-through material or when having an open configuration. The caddy can be taken in combination with the open storage rack, on which it may be deployed singly or in plural sets, for example, in one or more generally opposing pairs. The caddy may have left and right hand side reversibility and be adaptable to either, say, reversibly, or be made as a left or right hand version from a frame member and pivot combination, say, permanently, with such reversibility. A kit comprising the frame member and pivot, notably with such reversibility, is provided.

The instant invention is useful in storage.

Significantly, by the invention, the art is advanced in kind and provided a viable, versatile alternative. The present pivoting add-on storage caddy more effectively addresses storage problems, notably in the field of popular storage rack options such as open shelving. In particular, it addresses the under-capacities of open shelving to avoid problems in placement and retrieval of items large and small. The caddy can be especially useful in conjunction or combination with open shelving for the home, shop or garage. Storage is made more efficient when smaller items can be segregated from larger items in an open shelving system by placing the smaller items in the caddy for easy retrieval, thus allowing access to larger items that are segregated and stored on shelving behind the caddy, which are unencumbered when the caddy is swung to the side. Hence, the present caddy takes advantage of the underutilized space in front of storage racks by holding, for example, smaller standard household/shop items such as cans of lubricant, paint, cleaners, polishes and so forth, with the ability to swing the caddy outward for access stowed on the racks. And so, the caddy provides the benefit of efficiently utilizing such typically unused space. It can be see-through, say, as made of see-through material or with an open configuration, which allows a user to ascertain readily what is behind the caddy, say, stored on the open shelving shelves. An open configuration of the caddy, moreover, may provide for reach-through access to the shelves behind for placing or retrieving certain smaller items without necessarily pivoting the caddy. In addition, holes may be included in the bottom for efficient drainage, easy cleaning, or accessory attachment. The pivoting add-on storage caddy can have a plural-pivoting pivot, for example, a dual-pivoting pivot, which can increase flexibility of access to items stored in the caddy or behind it. The caddy can be made to have left and right hand reversibility, which may save on manufacturing costs such as by avoiding a need for separate left and right hand molds for pairs of left and right hand side caddies as of plastic, or otherwise simplifying manufacture. It can be efficient to make, and simple to install and use.

Numerous further advantages attend the invention.

BRIEF DESCRIPTION OF THE DRAWINGS

The drawings form part of the specification hereof. With respect to the drawings, which are not necessarily drawn to scale, the following is briefly noted:

FIG. 21 a top perspective view of the caddy being attached to an open rack storage unit, with mounting inside the vertical open shelf support; FIG. 22 a bottom perspective view of the caddy; FIG. 23 a top view, in detail, of part of its frame member/laterally projecting tray component (bin) bottom and attachment of an additional feature/accessory thereto; FIG. 24 another bottom view, but of the bin; FIG. 25 a front view of the bin with accessory; FIG. 26 a side view of the bin with accessory; FIG. 27 a rear perspective view, in detail, of part of the caddy being attached to the open rack storage unit, with mounting in front of the vertical open shelf support; FIG. 28 a perspective view of a hinge post assembly; and FIG. 29 a composite view, which includes an opposing left, right pair of the caddies attached to open rack shelving, and so forth.

DETAILED DESCRIPTION

The invention can be further understood by the detail set forth below, which may be read in view of the drawings. The same, as with the foregoing, is to be taken in an illustrative and not necessarily limiting sense.

The pivoting add-on storage caddy can be made with any suitable material(s). For instance, the frame member, which may be configured to be inclusive of a vertical door component and a laterally projecting tray component, may be made with wood, other plant-based material such as wicker, bark and so forth, or with plastic and/or metal; it may be made in several pieces, which are assembled with fasteners, such as by making it of wood with metal or plastic fasteners, or with use of glue; or it may be made in one, unitary piece, for instance, by molding it of plastic. As well, the pivot may be made, for instance, with metal, plastic or wood; it may be made in several pieces, which can be assembled, say, as a steel hinge pin for the vertical orientation onto which two brass hinge plates are pivotally slidably mounted, as a set of two or more ball and socket joints made of aluminum or steel, as a substantially cylindrical vertically oriented groove formed about the first end of the frame member and open to the side into which can be slid at least two balls or cylinders attached to arms for fixing to a suitable vertical substrate, and so forth and the like. Pivot stops to stop at least the upper pivoting contrivance along the pivot can be supplied, for instance, in metal or plastic, say, in a form of a nut to be screwed onto a threaded rod for a hinge pin, in a form of a malleable knock to be tightened about a hinge pin, in a form of a washer or other stop to be slid over a hinge pin and glued, and so forth. Certain embodiments can have an unthreaded hinge pin. Then, too, the pivot may be made to include one or more than one-piece pivoting contrivances of molded plastic living hinges.

In turn, as persons skilled in the art appreciate as well, the present caddy can be made and affixed to be in combination with a suitable substrate structure, for example, the vertical support of an open storage rack, by any suitable method. A number of these are alluded to herein. A kit may provide for assembly of the pivoting add-on storage caddy from components, parts, and accessories in a home environment.

The present caddy may be employed in any suitable configuration. Thus, it may be mounted singly or in multiple units, for instance, two or more units oriented vertically with respect to one another other, askew, say, kitty-comer, from one another, or, for example, in an opposing pair or plural numbers of opposing pairs, which may be vertically oriented with respect to one another, and so forth.

With more particular respect to the drawings, pivoting add-on storage caddy 100, which can be affixed to vertical support 9 for open shelving, includes frame member 10 and pivot 20. Additional feature(s) 30 may be present.

Figure 1:
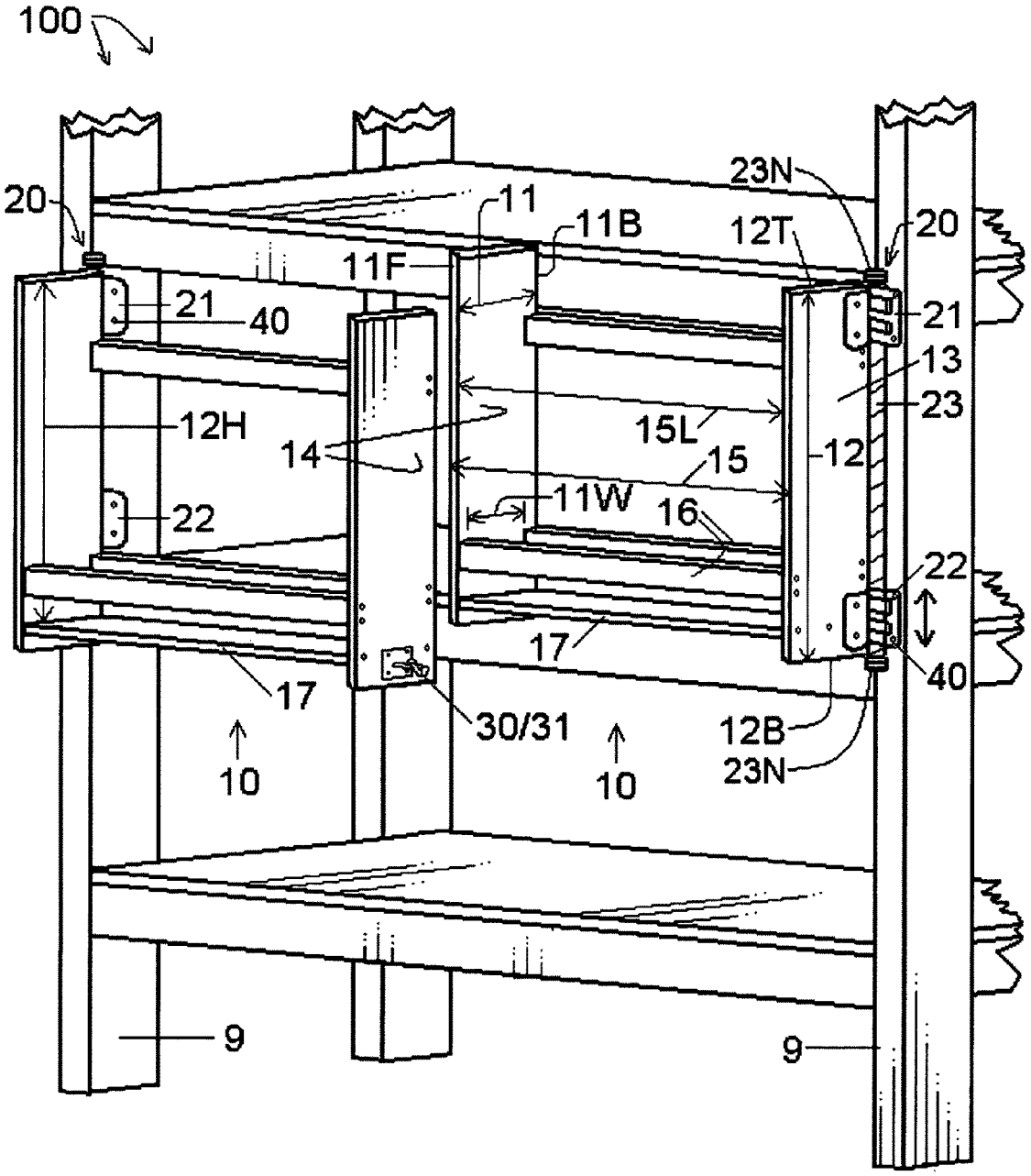
FIG. 1 is a perspective view, taken from the front, right, top, of two pivoting add-on storage caddies, their frame members made substantially with wood and their pivots made substantially with metal, and mounted, as a generally opposing pair opening centrally to one another, on opposing vertical supports of open wooden shelving, pivoted to closed positions.
Figure 2:
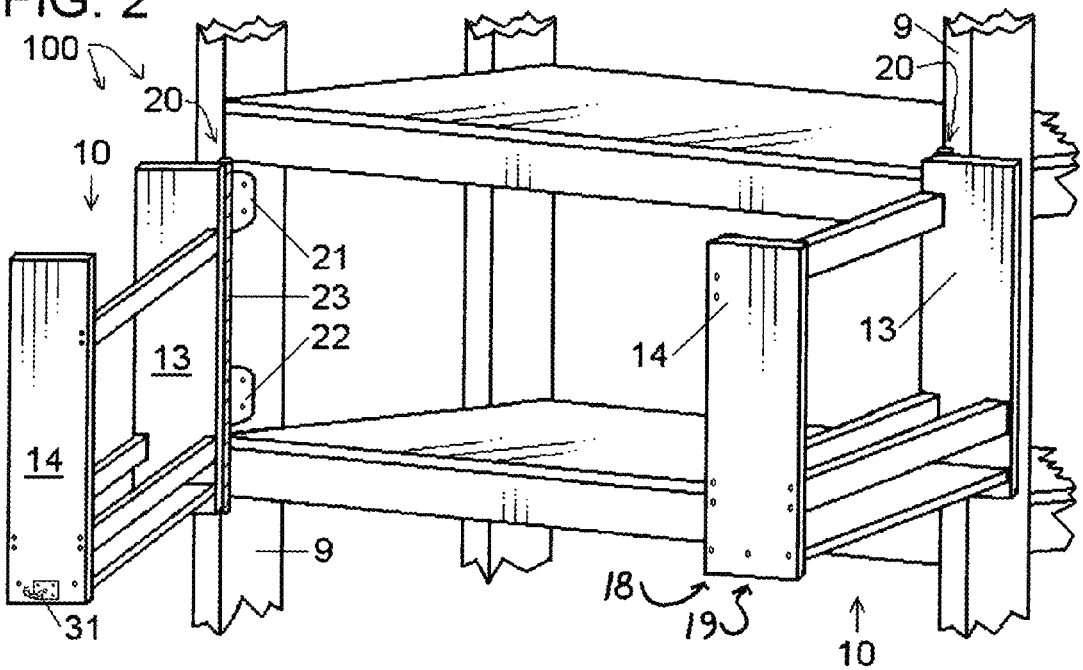
FIG. 2 is another perspective view, taken from the front, right, top, of the mounted pivoting add-on storage caddies of FIG. 1, pivoted to open positions.
Figure 3:
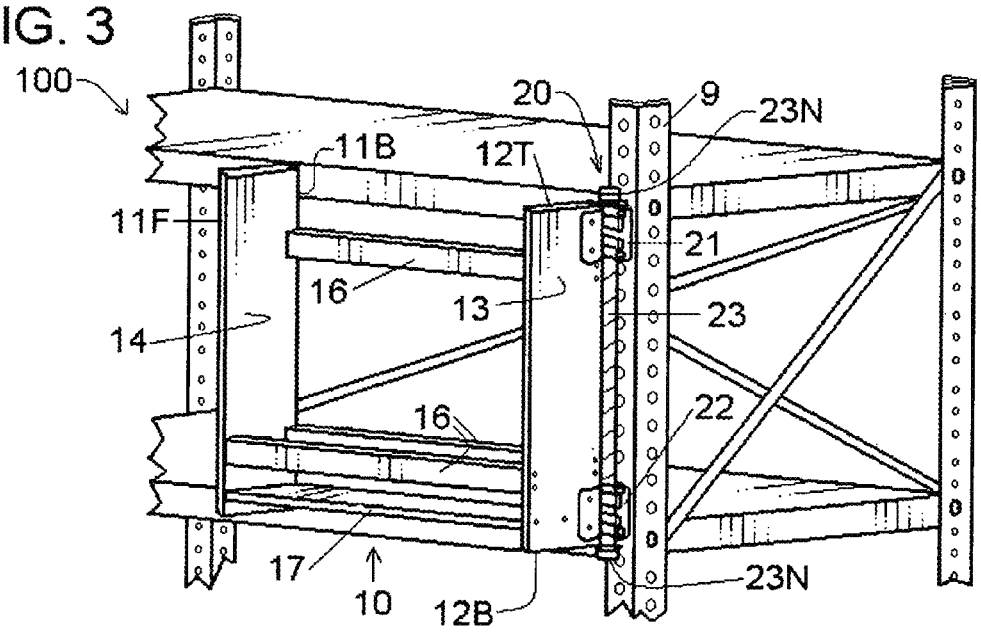
FIG. 3 is another perspective view, taken from the front, right, top, of one of the pivoting add-on storage caddies found within FIG. 1, here, the right caddy, mounted on a vertical support of common open metal rack shelving, which has prepositioned holes in its vertical supports.
Figure 4:
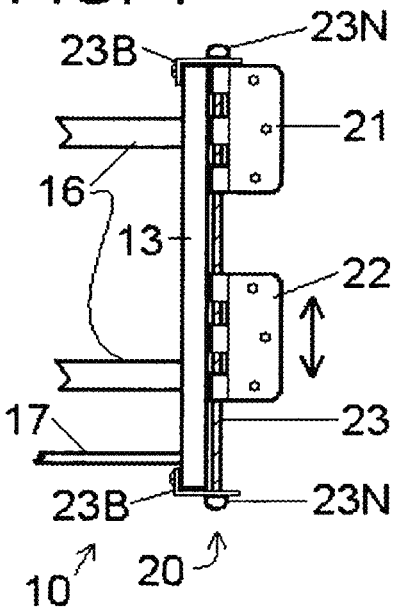
FIG. 4 is a front view of a right caddy such as found within FIGS. 1-3, illustrating in particular attachment of its pivot to its frame member.
Figure 5:
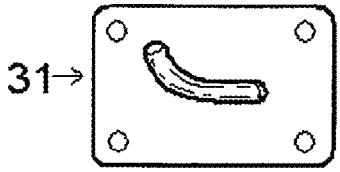
FIG. 5 is a front view of an additional feature, here, a hook member, found in the caddy depicted within FIGS. 1 and 2.
Figure 6:
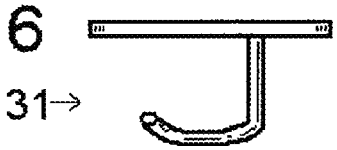
FIG. 6 is a top view of the hook member of FIG. 5.
Figure 7:
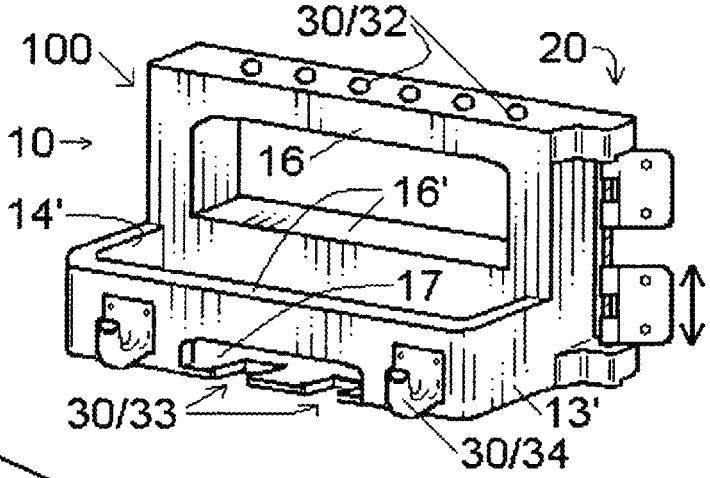
FIG. 7 is perspective view, taken from the front, right, top, of a pivoting add-on storage caddy having a frame member with various additional and other features.
Figure 8:
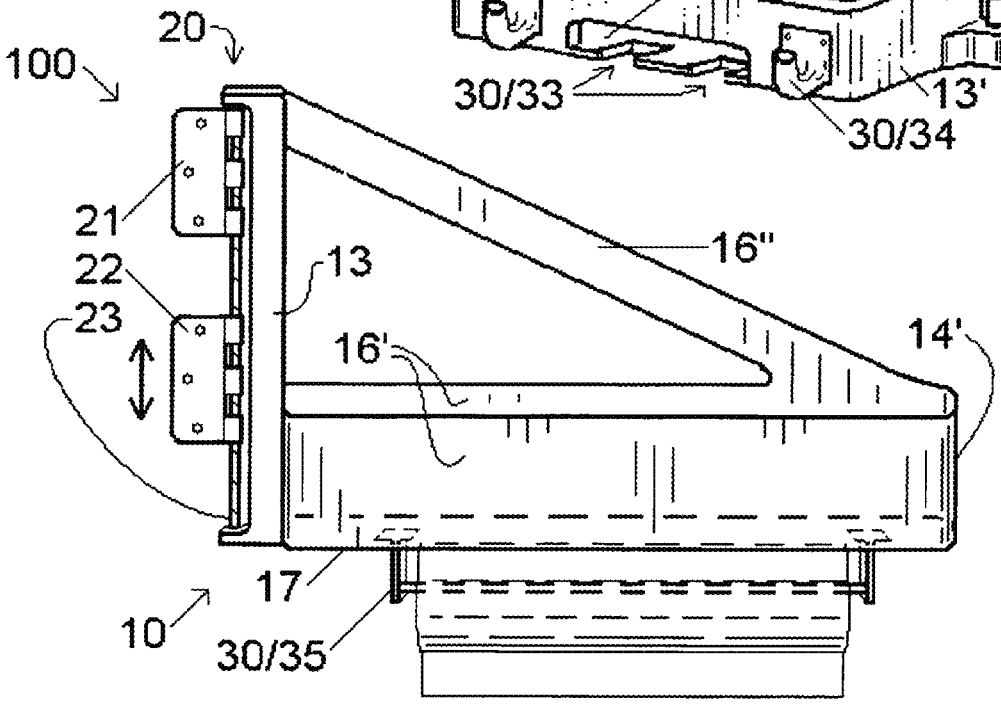
FIG. 8 is a perspective view, taken from the front, top, of a pivoting add-on storage caddy having a frame member made of see-through plastic.
Figure 9:
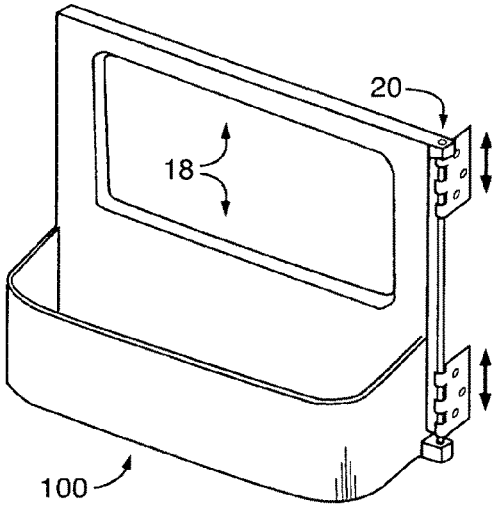
FIG. 9 is a perspective view, taken from the front, right, top of a pivoting add-on storage caddy. Its frame member may be made, for example, with plastic or wood.
Figure 10:
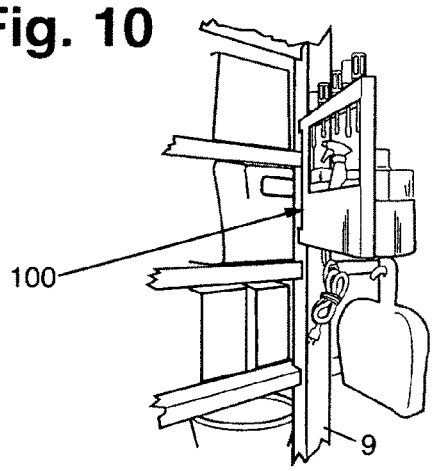
FIG. 10 is a perspective view, taken from the rear, left of a pivoting add-on storage caddy as of FIG. 9, which is mounted to wooden shelving, and has, moreover, tool-insertion holes and hooks for hanging items such as an extension cord and a dustpan. Compare, FIGS. 1,2 and 5-7.
Figure 11:
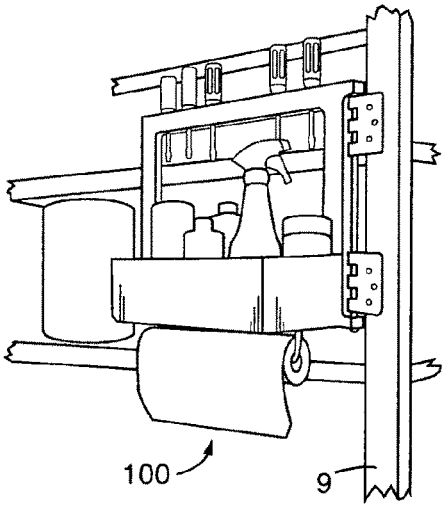
FIG. 11 is a perspective view, taken from the front, right of a pivoting add-on storage caddy as of FIG. 10, which is mounted to wooden shelving, but includes a paper towel roll holder. Compare, FIGS. 7 and 8.
Figure 12:
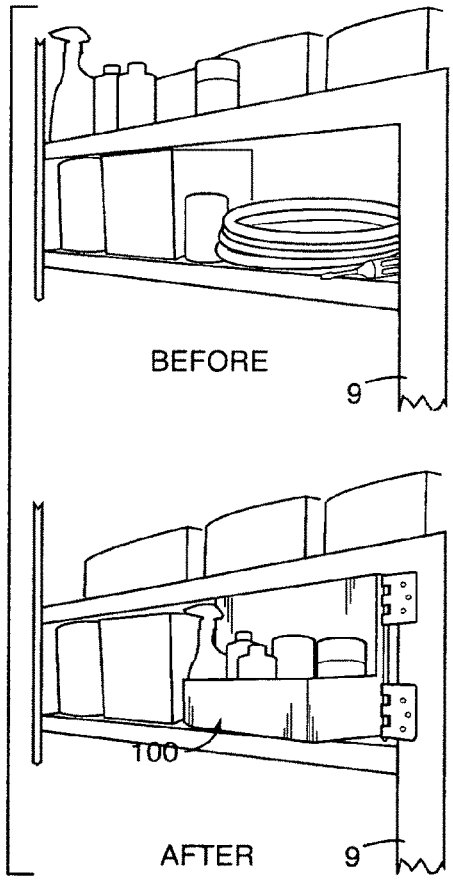
FIG. 12 is a perspective view, taken from the front, right of a pivoting add-on storage caddy, mounted to wooden shelving. Its frame member is made with sheet metal.
Figure 13:
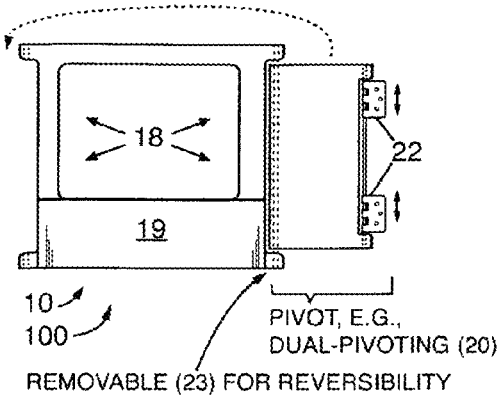
FIG. 13 is a front view of a pivoting add-on storage caddy with a plural-pivoting pivot. It also embodies a provision for left and right hand reversibility, i.e., left to right side pivot mounting exchange, showing its right hand side mounting configuration.
Figure 14:
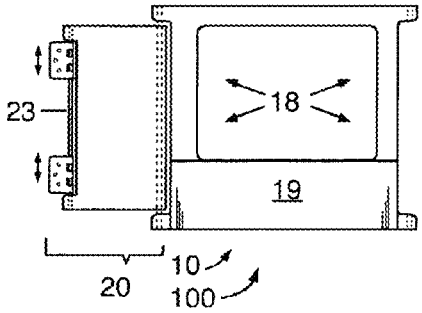
FIG. 14 is a front view of the caddy of FIG. 13, showing its left hand side mounting configuration.
Figure 15A:
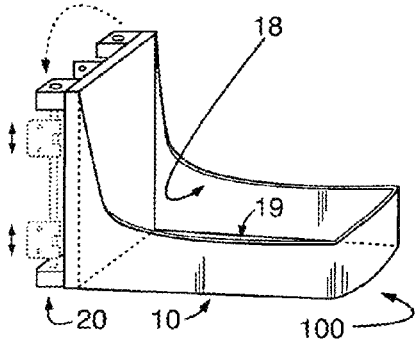
FIGS. 15A-17 are perspective views of pivoting add-on storage caddies hereof, each with some other provisions for left and right hand reversibility, i.e., a rear to front pivot mounting exchange provision with FIG. 15A illustrating exchange of a pivot component, e.g., a hinge pin with pivoting contrivances, e.g., hinge plates, FIG. 115B illustrating rotation of a pivot, and FIG. 15C illustrating exchange of a complete or modular pivot; a top to bottom laterally projecting tray component mounting exchange provision (FIG. 16); and a front to rear laterally projecting tray component mounting exchange provision (FIG. 17).
Figure 15B:
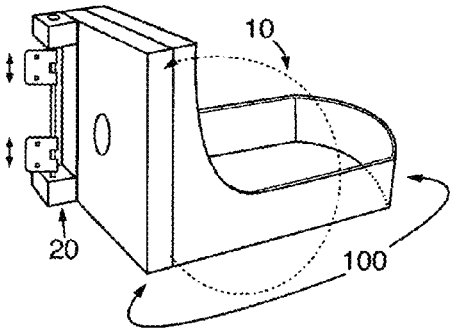
Figure 15C:
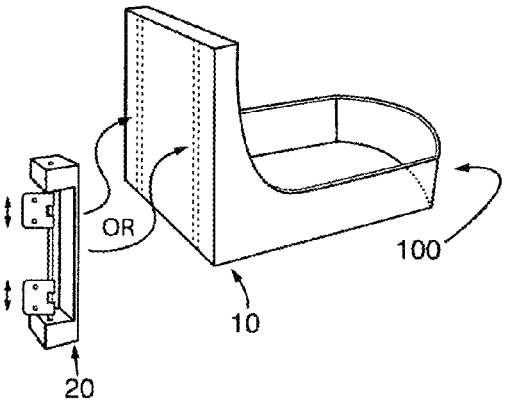
Figure 16:
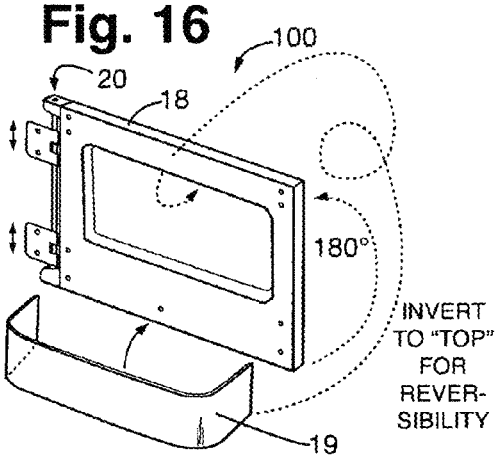
Figure 17:
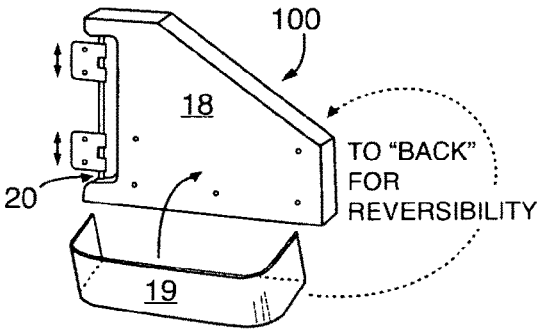
Figure 18:
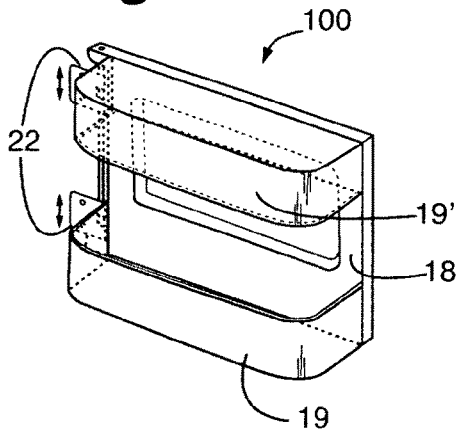
FIG. 18 is a perspective view, taken from the front, right, top, of a pivoting add-on storage caddy with a bottom laterally projecting tray component and an inverted top laterally projecting tray component, which projects in the same direction as the bottom laterally projecting tray component with respect to the vertical door component. This provides not only a top "ceiling" for the caddy, which may help guard stored items, but also left and right hand reversibility through a top to bottom caddy rotation provision.
Figure 19:
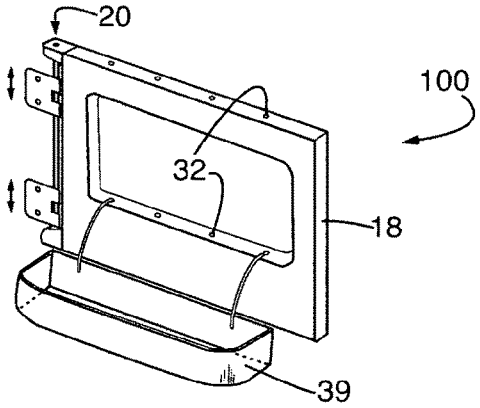
FIG. 19 is perspective view, taken from the front, right, top, of a pivoting add-on storage caddy. Its frame member has additional features, with a vertical door component but no laterally projecting tray component. It has left and right hand reversibility.
Figure 20:
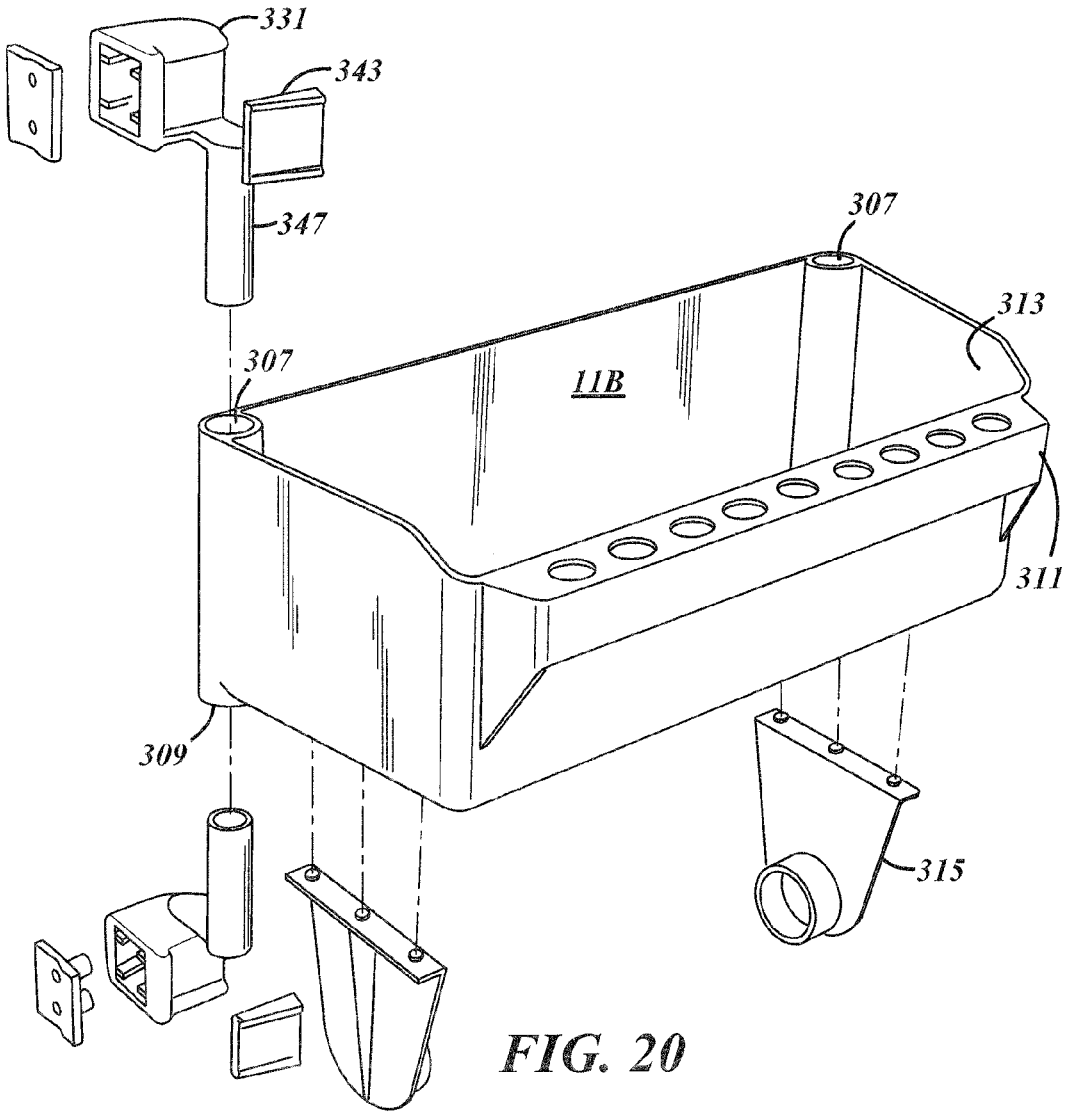
FIGS. 20-29 are views of a pivoting, add-on storage caddy hereof having a pivot embracing a split, vertically oriented hinge post ensemble that is pivotally associated with a corresponding securing contrivance, in which a vertically slidable relationship exists with respect to hinge posts of the ensemble—with FIG. 20 an exploded view of the caddy, which has left or right hand side pivoting capability.
Figure 21:
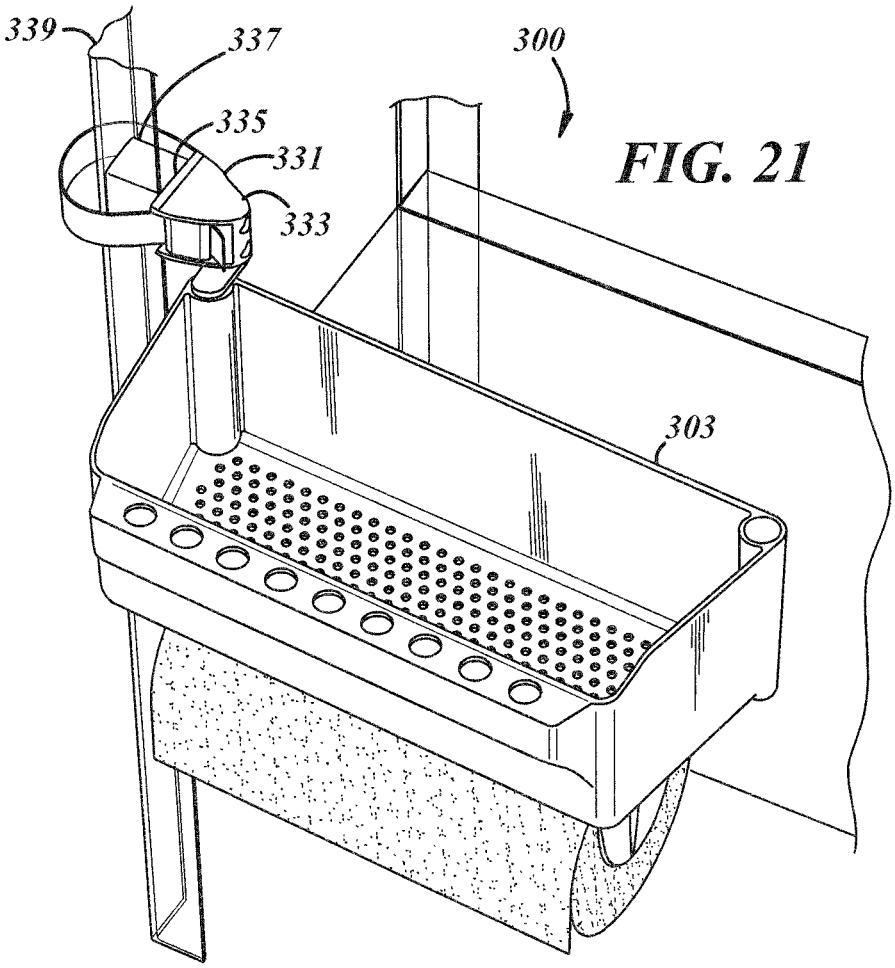
Figure 22:
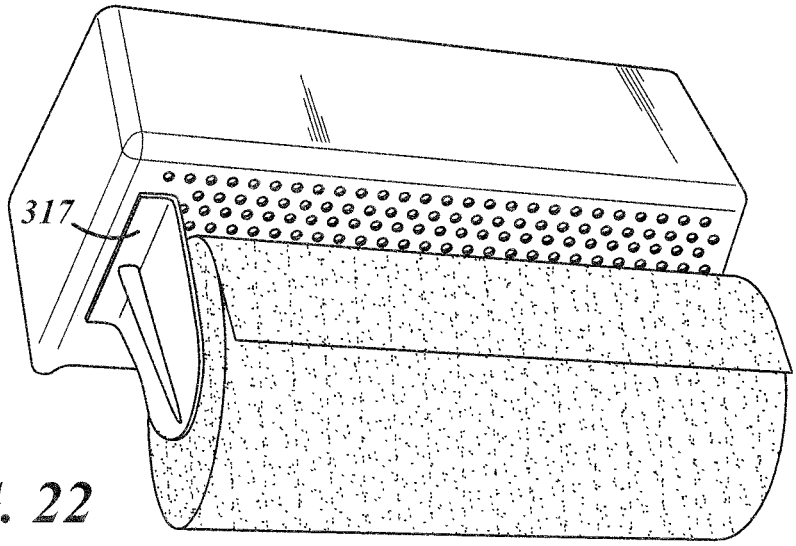
Figure 23:
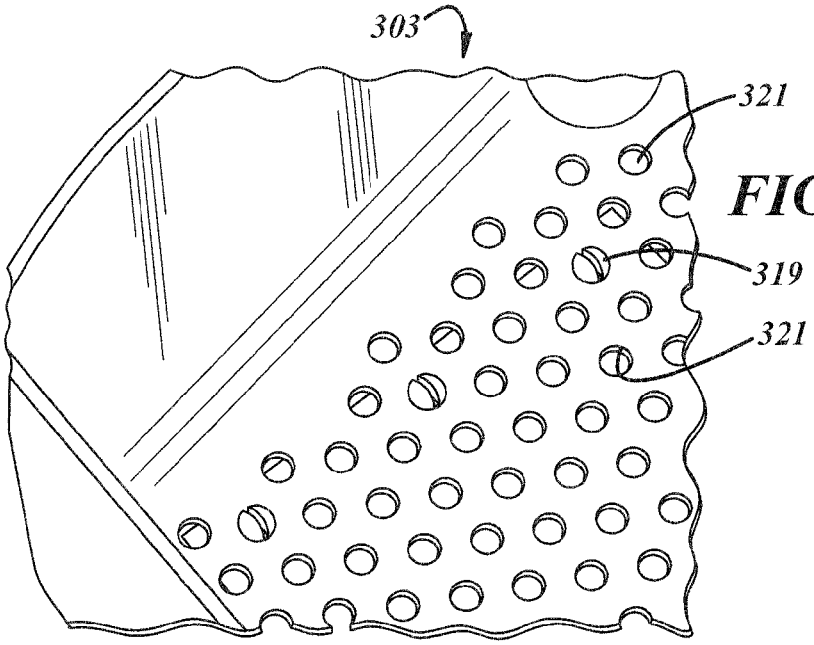
Figure 24:
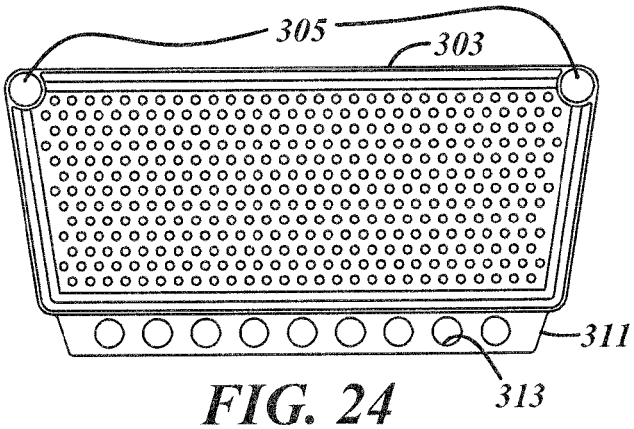
Figure 25:
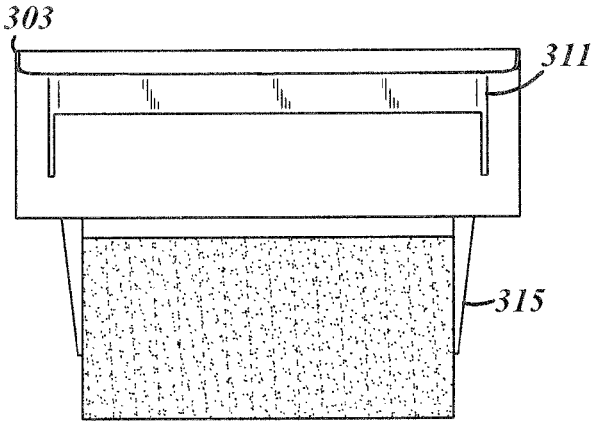
Figure 26:
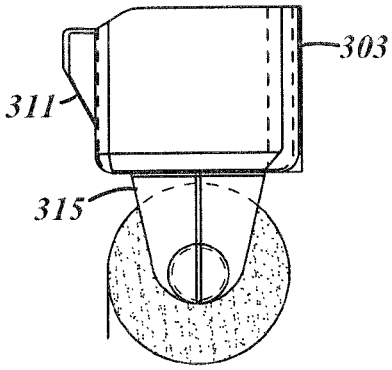
Figure 27:
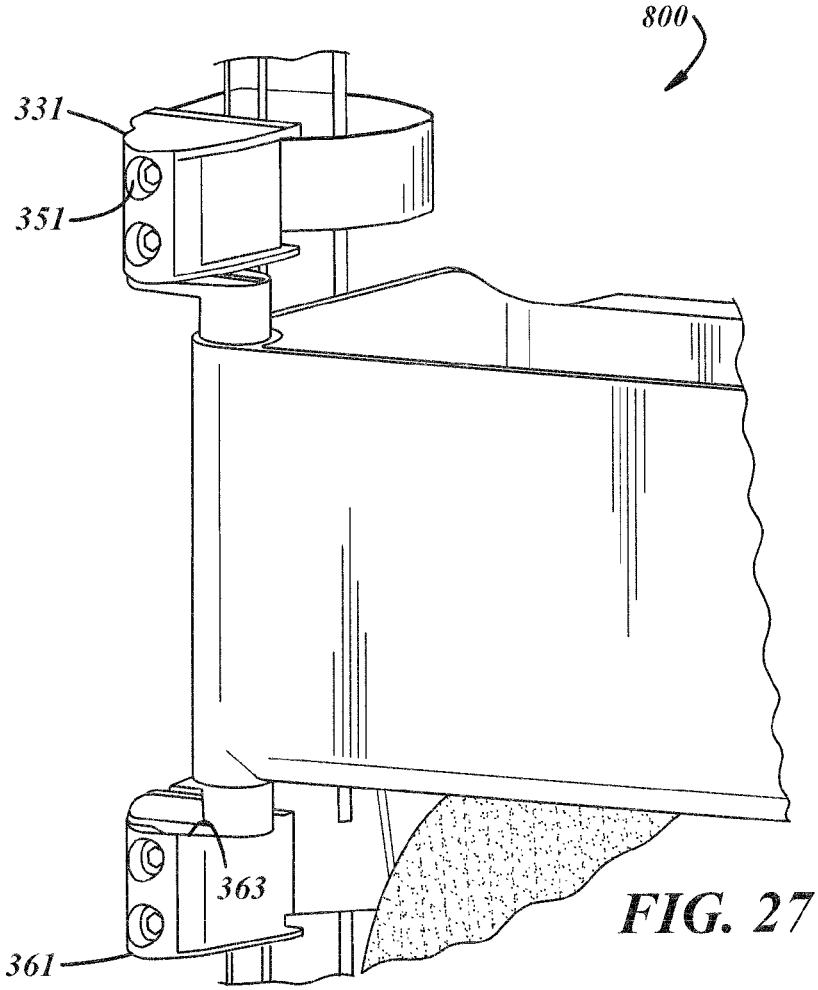
Figure 28:
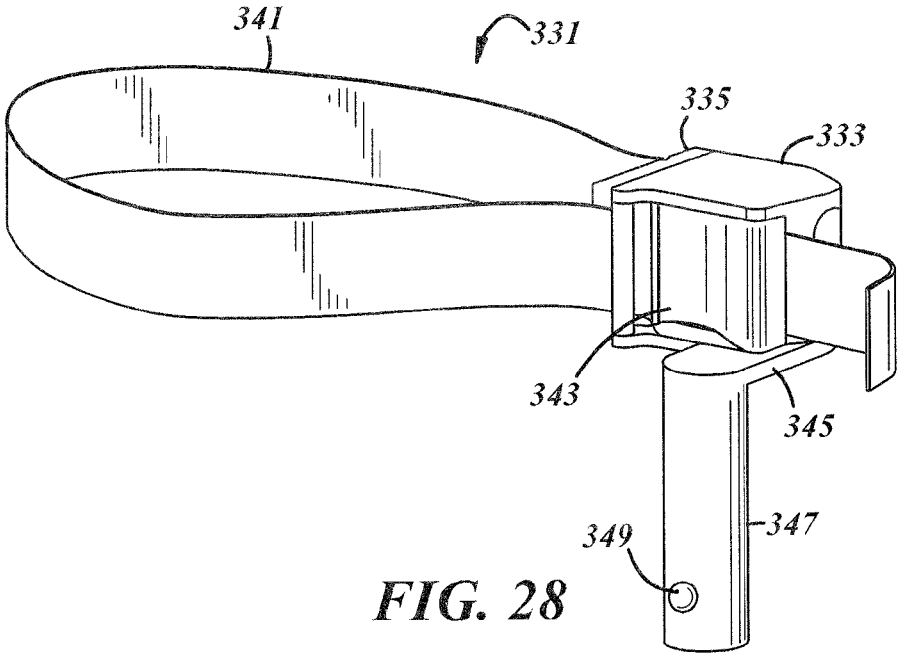
Figure 29:
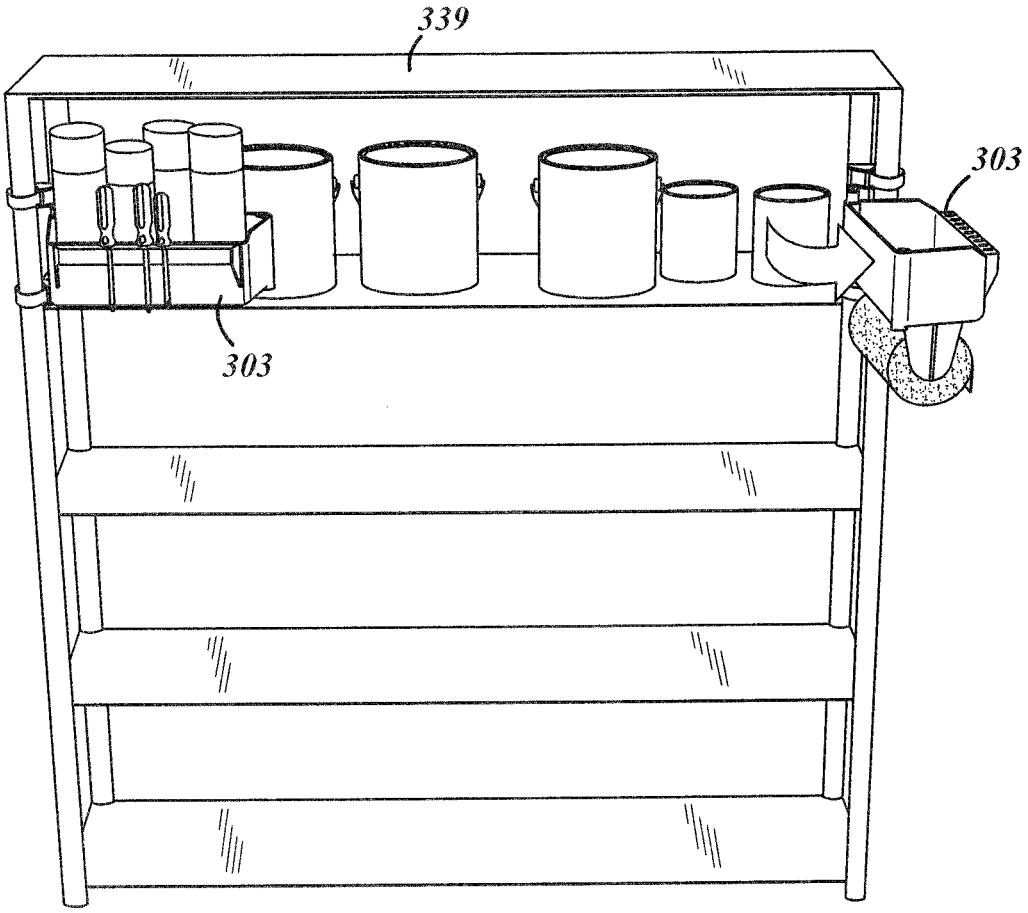
Figure 30:
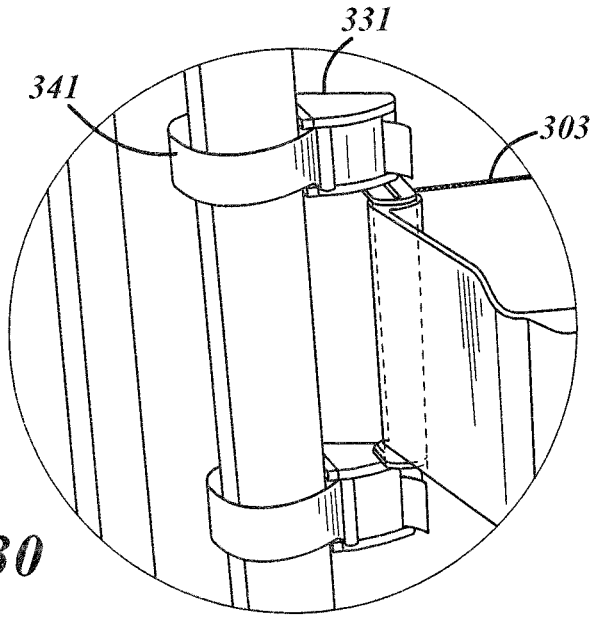
FIG. 30 is an enlargement illustrating the connection of the left caddy in FIG. 29 to the storage shelf.
Figure 31:
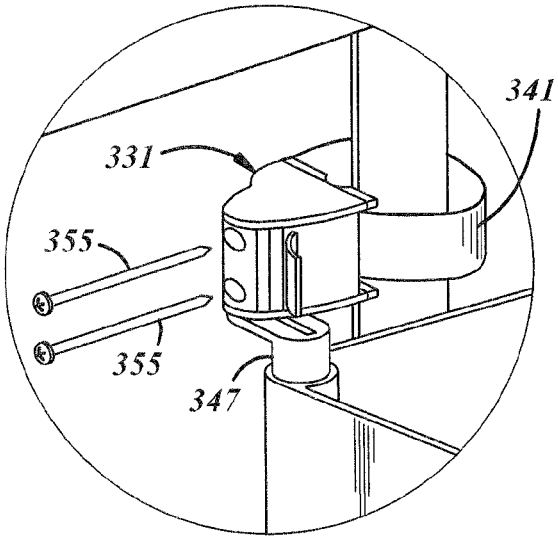
FIG. 31 is an enlargement illustrating attachment of a hinge support to a storage shelf shown in FIG. 30.
Figure 32:
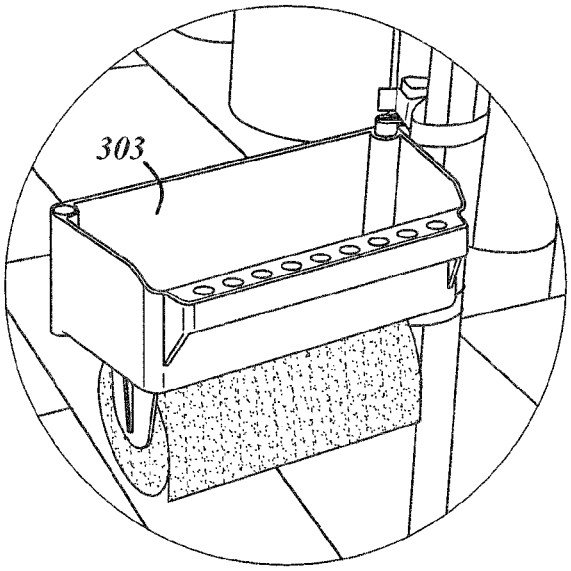
FIG. 32 is an enlargement illustrating the connection of the right caddy in FIG. 29 to the storage shelf.
Figure 33:
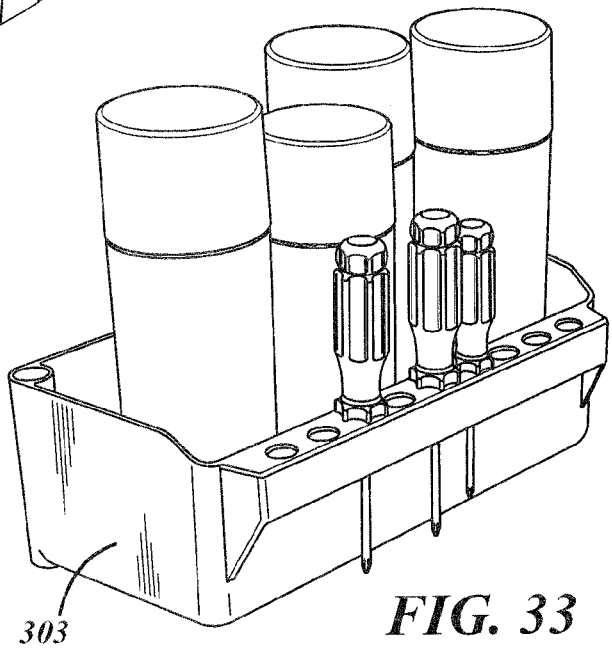
FIG. 33 is an enlarged perspective view of the caddy shown in FIG. 29.

The frame member 10 has overall width 11 from back 11B to front 11F, for instance, about from three to six inches, for example, about 4¼ inches (FIGS. 1-3) or about 3¾ inches (FIG. 8), with inside width 11W, for instance, about from ⅛ of an inch to an inch less than the overall width 11, say, about 3⁹⁄₁₆ inches (FIGS. 1-3) or about 3½ inches (FIG. 8); overall height 12 with bottom 12B, inside height 12H, and top 12T, which may be open, with the overall height 12, for instance, about from six or ten inches to one foot or two or three or more feet, say, about from seven inches to a foot or about from fifteen to twenty-five inches, for example, about sixteen inches (FIGS. 1-4) or about eight inches (FIG. 8), and with the inside height 12H, for instance, about from ⅛ of an inch to two to six inches less than the overall height 12, say, about 14½ inches (FIGS. 1-4) or about 7⅞ inches (FIG. 8); and first end 13 or lower first end 13' and second end 14 or lower second end 14', which may define overall length 15, for instance, about from six or ten inches to one foot or two or three or more feet, say, about from seven inches to a foot or about from fourteen inches to about two feet, for example, about 16⅜ inches (FIGS. 1-3) or about ten inches (FIG. 8) with inside length 15L, for instance, about from ⅛ of an inch to an inch less than the overall length 15, say, about sixteen inches (FIGS. 1-3) or about 9⅞ inches (FIG. 8). Other suitable dimensions may be employed, for example, to better conform to a specific commercially available open shelving unit. Horizontal supports 16, which may be lower unitary support 16' or a diagonal support 16", can span the first and second ends 13, 13', 14, 14' or a portion thereof to stiffen and/or provide restraints for items stored on shelf 17 in the frame member 10. The lower unitary support 16' is integral or connected with the shelf 17. Vertical door component 18 may be considered to be made up of the feature(s) 13, 13', 14 and 14' (rearmost portions); 16, 16' and 16" (rear); and 17 (rearmost portion). In cortjunction with the vertical door component 18, laterally projecting tray component 19, 19', which can impart significant asymmetry to the caddy 100, may be considered to be made up of the feature(s) 13, 13', 14 and 14' (middle to front portions); 16, 16' and 16" (front); and 17 (middle to front portion). The frame member 10 may have the vertical door component 18 without a laterally projecting tray component (FIG. 19).

The frame member may include hinge post securing contrivance 19, which embraces receptacle system having a female bottom facing receptacle opening and a female top facing receptacle opening. Alternatively, male posts may be employed in lieu of one or more of the female bottom or top facing receptacle openings.

The pivot 20 is provided about the first end 13 of the frame member 10. Upper pivoting contrivance 21 and lower pivoting contrivance 22, say, separate hinge plates, can be adjustably, substantially spaced apart vertically in a direction substantially parallel with the height 12 of the frame member 10. Vertically oriented hinge pin 23, which may be threaded (FIGS. 1-4, 7 and 8), for example, a ³⁄₁₆-inch diameter threaded steel rod, is attached to the first end 13 of the frame member 10 by fasteners such as L-brackets 23B with holes, screws, and threaded nuts 23N (FIGS. 1-4) and/or by being molded-in with or screwed into the remaining structure of the frame unit 10 (FIGS. 7-19) so that the hinge plate pivoting contrivances 21, 22 pivotally, vertically, slidably mount on the hinge pin 23. A single long hinge pin may mount, through a series of sets of correspondent hinge plates, a plurality of frame members vertically with respect to one another, with the resultant caddies vertically oriented on the single long hinge pin and mounted to a suitable substrate structure. The pivot may embrace split, vertically oriented hinge post ensemble that is pivotally associated with the hinge post securing contrivance, in which a vertically slidable relationship exists with respect to hinge posts of the ensemble. The split, vertically oriented hinge post ensemble may include a pair of opposing male hinge posts, bottom and top, the bottom post facing upward and receivable in the bottom facing receptacle opening of the receptacle system, and the top post facing downward and receivable in the top facing receptacle opening of the receptacle system. Alternatively, female receptacles may be employed in lieu of one or more of the bottom or top male posts, which would interact with corresponding male posts on the frame member 10 such as those mentioned above. Attachment of the hinge post ensemble, and hence the caddy, to the vertical support may be accomplished with hinge post securement system, which, for example, may be configured as a latch/clamp member that may be commercially available and includes securing strap, and/or may be accomplished with screws, glue and/or magnets, and so forth and the like.

The additional feature(s) 30 may be provided. For instance, accessory(ies) such as serpentine hook(s) or peg(s) 31 may be added about or on a panel below the bottom 12B or about an end, say, the second end 14 of the frame member 10 for hanging tool(s), rag(s) and so forth. Tool channel(s) or hole(s) 32 may be provided in the frame member 10, say, in a vertical orientation generally in or about a frame member front 11F or in an upper horizontal support 16, for inserting tools such as awls, files, knives, pliers, screwdrivers, and so forth. Specialized slot(s) 33 may be provided in the frame member 10, say, within an exposed, accessible part the shelf 17, to insert and suspend suitable tools or equipment, for example, baseball bat(s) with balls and a glove stored within confines of front and rear horizontal supports 16, 16', perhaps along with cleaning equipment and so forth. U-shaped clip(s) or hook(s) 33 may be provided or mounted on the frame member 10, say, on a lower horizontal support 16' at the front, for example, to hang a broom or tennis racket. Paper towel roll holding contrivance 35 may be provided, say, underneath the shelf 17, which may, for example, be affixed with snaps. Removable hanging basket 39 may be provided, for example, to hang from a lower set of the hole(s) 32. Thus, additional storage may be provided the pivoting, add-on storage caddy 100 through such additional feature(s) or accessory(ies).

For use, the caddy can be affixed to the vertical support 9 or another suitable substrate structure. The screws and/or straps, glue and/or magnets, and so forth and the like may be used. The upper pivoting contrivance may be mounted to the vertical support 9 first, followed by the lower pivoting contrivance, for more practically effective adjustability and use, or vice versa as the situation presents itself as, for example, with the hinge post securing contrivance and split, vertically oriented hinge post ensemble system.

Referring to FIGS. 20 through 33 an arrangement 300 of the pivoting caddy for a storage shelf is provided. Arrangement 300 has a caddy with a box shaped body 303. The caddy box is provided for storage of material. Along its extreme rearward ends, the caddy body has connected there to vertical bearings 305. The bearings 305 have upper opening 307 and a lower opening 309. A front end of caddy body 303 has a tool ledge 311 having holes 313 performing the function of previously described holes 30 and 32 for the other embodiments. The caddy also has two frames 315 which form a towel rack. The frames of the how rack along and upper horizontally extending portion 317 have on a top side split vertical hook like projections 319 which extend into holes 321 of the caddy body 303 and then lockable he extend outward to connect the towel rack frames 315 with the caddy body 303. The extensive numbers of holes 321 in the caddy body 303 allow for the connection of various hooks and other devices to the caddy body if desired. The caddy body 303 may be fabricated from a polymeric material such as plastic or other suitable materials.

The caddy body 303 is pivotally secured to a storage shelf 330 by a first hinge support 331. The first hinge support has a body 333 that is generally triangular shaped having a triangular base 335. The base 335 is provided for abutting a structural member 337 of a storage shelf 339. The first hinge support 331 has connected there to a flexible strap 341 which can be retained by a pivotal clamping latch member 343 to allow the hinge support 331 to be connected to the storage shelf structural member 339. On and in of the first hinge support body 333 generally opposite the face 335 there is a connected lateral arm 345. Lateral arm 345 has connected there to a vertically projecting pivot pin 347. Pivot pin 347 has a plunger 349. The pivot pin 347 is insertable within the bearing 305 of the caddy body to its top hole 307 two pivotally mount the caddy body 303 to the shelf structural member.

The plunger 349 prevents the caddy body from pivoting to freely and partially restrained its rotation upon the pivot pin 347. The first hinge support 331 also has 2 predrilled holes 351 to provide for the use of fasteners 355 to attach the first hinge support 331 to the structural member of the storage shelf.

The arrangement 300 also has a second hinge body 361 that is substantially identical to the first hinge body the 31 with the exception that it's lateral arm 363 extends the opposite direction of lateral arm 345 of the first hinge support member. The second hinge support member also has a substantially similar pivot pin which inserts in the lower opening 309 of the bearing 305 opposite the pivot pin of the first hinge support. The two hinge support members are adjustably in slidably substantially spaced apart vertically in relation to one another therefore the distances between the first and second hinge support members can be adjusted allowing for installation of the caddy body 303 to be adjustable for various storage shelf applications and can be switch as required if utilize for attaching the caddy body 303 two the opposite side of the storage shelf.

CONCLUSION TO THE INVENTION

The present invention is thus provided. Various feature(s), part(s), subcombination(s) and/or combination(s) can be employed with or without reference to other feature(s), part(s), subcombination(s) and/or combination(s) in the practice of the invention, and numerous adaptations and modifications can be effected within its spirit, the literal claim scope of which is particularly pointed out as follows:

What is claimed is:

1. An arrangement for a pivoting caddy for a storage shelf, said arrangement comprising:

a caddy having a body for storage of material, said caddy having connected to said caddy body a generally vertical bearing with upper and lower openings;

a first hinge support having a body with a face for abutting a structural member of the storage shelf, said first hinge support having a flexible strap allowing for connection of said first hinge support with the structural member of the storage shelf, and said first hinge support having a lateral arm connected with said first hinge support body, and said first hinge support having a vertically projecting pivot pin connecting with said lateral arm, said pivot pin being insertable within said caddy bearing; and a second hinge support essentially identical to said first hinge support except said second hinge support having a body connected lateral arm extending generally opposite said first hinge support lateral arm and wherein a pivot pin of said second hinge support projects into said caddy bearing opposite said first hinge support pivot pin.

2. An arrangement as described in claim 1 wherein at least one of said hinge supports has a pre-drilled hole to allow it to be attached to the shelf structural member with a fastener.

3. An in arrangement as described in claim 2 wherein said hinged support has a plurality of holes for a plurality of fasteners.

4. An arrangement as described in claim 1 wherein said caddy has bearings on opposite ends of said caddy.

5. An arrangement as described in claim 1 wherein said caddy is fabricated from a plastic material.

6. An arrangement as described in claim 1 wherein said first pivot is fabricated the plastic material.

7. An arrangement as described in claim 1 wherein said hinge support has a triangular body with said face forming a base of said triangular body.

8. An arrangement as described in claim 7 wherein said hinge support body is pre-drilled for a plurality of fasteners.

9. An arrangement as described in claim 1 wherein said first hinge support lateral arm is connected on said first hinge support body on an end of said first hinge support body generally opposite said face.

10. An arrangement for a pivoting caddy for a storage shelf, said arrangement comprising:

a caddy having a body for storage of material, said caddy along opposite rear extreme ends having connected to said caddy body generally vertical bearings with upper and lower openings;

a first hinge support having a triangular shaped body with a face along a triangular base for abutting a structural member of the storage shelf, said first hinge support having a flexible strap allowing for connection of said first hinge support with the structural member of the storage shelf and said first hinge support having a plurality of predrilled holes to provide for fastener connection with the support shelf structural member, and said first hinge support having a lateral arm connected with said first hinge support body at an end of said first hinge support body away from said face, and said first hinge support having a vertically projecting pivot pin connecting with said lateral arm, said pivot pin being insertable within one of said caddy bearing; and a second hinge support essentially identical to said first hinge support except said second hinge support having a body connected lateral arm extending generally opposite said first hinge support lateral arm and wherein a pivot pin of said second hinge support projects into said caddy bearing opposite said first hinge support pivot pin.

11. An arrangement for a pivoting caddy for a storage shelf, said arrangement comprising:

a caddy having an open box shaped body for storage of material, said caddy along opposite rear extreme ends having connected to said caddy body generally vertical bearings with upper and lower openings;

a polymeric first hinge support having a triangular shaped body with a face along a triangular base for abutting a structural member of the storage shelf, said first hinge support having a flexible strap and latched clamp allowing for connection of said first hinge support with the structural member of the storage shelf and said first hinge support having a plurality of predrilled holes to provide for fastener connection with the support shelf structural member, and said first hinge support having a lateral arm connected with said first hinge support body at an end of said first hinge support body away from said face, and said first hinge support having a vertically projecting pivot pin connecting with said lateral arm, said pivot pin being insertable within one of said caddy bearing, said pivot pin having a plunger to restrain free pivotal movement of said caddy; and a second hinge support essentially identical to said first hinge support except said second hinge support having a body connected lateral arm extending generally opposite said first hinge support lateral arm and wherein a pivot pin of said second hinge support projects into said caddy bearing opposite said first hinge support pivot pin.

* * * * *